US009129757B2

(12) United States Patent
Kanbayashi et al.

(10) Patent No.: US 9,129,757 B2
(45) Date of Patent: Sep. 8, 2015

(54) WATERPROOF TYPE SWITCH AND ELECTRONIC DEVICE

(71) Applicant: FUJITSU LIMITED, Kawasaki-shi, Kanagawa (JP)

(72) Inventors: Satoshi Kanbayashi, Kawasaki (JP); Shingo Yamaguchi, Kawasaki (JP); Hayato Shida, Kawasaki (JP); Tetsuya Hori, Kawasaki (JP); Kazuhiro Nakashima, Kawasaki (JP); Hirohisa Tokunaga, Kunitachi (JP)

(73) Assignee: FUJITSU LIMITED, Kawasaki (JP)

( * ) Notice: Subject to any disclaimer, the term of this patent is extended or adjusted under 35 U.S.C. 154(b) by 295 days.

(21) Appl. No.: 13/778,946

(22) Filed: Feb. 27, 2013

(65) Prior Publication Data

US 2013/0299324 A1 Nov. 14, 2013

(30) Foreign Application Priority Data

May 11, 2012 (JP) ..... 2012-109276

(51) Int. Cl.
*H01H 13/06* (2006.01)
*H01H 13/86* (2006.01)
*H01H 9/04* (2006.01)

(52) U.S. Cl.
CPC ..... *H01H 9/04* (2013.01); *H01H 13/06* (2013.01); *H01H 13/86* (2013.01); *H01H 2223/002* (2013.01); *H01H 2225/002* (2013.01); *H01H 2239/074* (2013.01)

(58) Field of Classification Search
CPC ..... H01H 13/06; H01H 9/04; H01H 9/042; H01H 2223/002; H01H 13/86
USPC ..... 200/302.1, 302.2
See application file for complete search history.

(56) References Cited

U.S. PATENT DOCUMENTS

| | | | | |
|---|---|---|---|---|
| 7,705,258 | B2 | 4/2010 | Geldmacher | |
| 8,736,001 | B2 * | 5/2014 | Salatino et al. | 257/415 |
| 8,854,313 | B2 | 10/2014 | Takeda | |

(Continued)

FOREIGN PATENT DOCUMENTS

| | | |
|---|---|---|
| CN | 101133222 A | 2/2008 |
| JP | 09-259697 | 10/1997 |
| JP | 10-70374 | 3/1998 |

(Continued)

OTHER PUBLICATIONS

Chinese Office Action application No. 201310102162.1 issued Dec. 25, 2014.

(Continued)

*Primary Examiner* — Amy Cohen Johnson
*Assistant Examiner* — Marina Fishman
(74) *Attorney, Agent, or Firm* — Squire Patton Boggs (US) LLP

(57) ABSTRACT

A waterproof type switch includes: a waterproof sheet including a flat portion and a side wall portion disposed around the flat portion, an upper portion of the side wall portion coupled to an edge portion of the flat portion; a switch disposed below the flat portion; and an electronic component coupled to an upper surface of the flat portion, the electric component being used as a key top, wherein the waterproof sheet includes a rubber and a reinforcing plate including a first reinforcing plate disposed on the upper surface of the flat portion and coupled to the electric component.

14 Claims, 17 Drawing Sheets

(56) References Cited

U.S. PATENT DOCUMENTS

| | | | | |
|---|---|---|---|---|
| 2011/0309482 | A1* | 12/2011 | Salatino et al. | 257/659 |
| 2012/0287587 | A1* | 11/2012 | Los | 361/749 |

FOREIGN PATENT DOCUMENTS

| | | | |
|---|---|---|---|
| JP | 2005-78846 | | 3/2005 |
| JP | 2005-216609 | | 8/2005 |
| JP | 2006-54062 | | 2/2006 |
| JP | 2010108749 | A | 5/2010 |
| WO | 2011/081059 | A1 | 7/2011 |
| WO | 2011/160041 | A2 | 12/2011 |

OTHER PUBLICATIONS

Office Action dated May 21, 2015, issued in corresponding Chinese Patent Application No. 201310102162.1 (with English translation).

* cited by examiner

WATERPROOF TYPE SWITCH AND ELECTRONIC DEVICE

CROSS-REFERENCE TO RELATED APPLICATION(S)

This application is based upon and claims the benefit of priority of the prior Japanese Patent Application No. 2012-109276, filed on May 11, 2012, the entire contents of which are incorporated herein by reference.

FIELD

The embodiments discussed herein are related to a waterproof type switch and an electronic device equipped with the waterproof type switch.

BACKGROUND

An electronic device such as a mobile phone includes a waterproof type switch. The waterproof type switch includes a switch that turns on and off an electrical signal, a key top to be pressed down by a finger or the like, and a waterproof sheet. The key top and the waterproof sheet are integrally formed using a plastic or the like. The waterproof type switch is attached to a housing so that a clearance gap is not formed between the waterproof sheet and the housing.

When the key top of the waterproof type switch attached to the housing is pressed down, the waterproof sheet bends and the lower side of the key top presses down the moving contact of the switch. Therefore, the switch is put into an on-state or an off-state.

A related art is disclosed in Japanese Laid-open Patent Publication No. 2005-216609, Japanese Laid-open Patent Publication No. 10-70374, Japanese Laid-open Patent Publication No. 2005-78846, or Japanese Laid-open Patent Publication No. 2006-54062.

SUMMARY

According to one aspect of the embodiments, a waterproof type switch includes: a waterproof sheet including a flat portion and a side wall portion disposed around the flat portion, an upper portion of the side wall portion coupled to an edge portion of the flat portion; a switch disposed below the flat portion; and an electronic component coupled to an upper surface of the flat portion, the electric component being used as a key top, wherein the waterproof sheet includes a rubber and a reinforcing plate including a first reinforcing plate disposed on the upper surface of the flat portion and coupled to the electric component.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

An electronic device such as a mobile phone may be made thinner or highly functional. Since a portable electronic device is made highly functional, an electronic component such as a biometric authentication module may be disposed, for example, in a key top.

When an electronic component is joined onto the key top of a waterproof type switch, the thickness of the switch becomes thick, and the portable electronic device may not be made thinner. Therefore, the electronic component itself may be used as the key top, and the electronic component and the waterproof sheet may be subjected to an integral molding (insert molding) process. In the integral molding process, owing to heat and pressure at the time of molding, a rubber to be the waterproof sheet and the electronic component may be tightly joined to each other.

Since an electronic component such as a biometric authentication module or an electric wire to be coupled to the electronic component, for example, a resin coated wire or the like, is weak against heat, when the electronic component and the waterproof sheet are subjected to the integral molding process, the electronic component or the electric wire may be damaged owing to the heat at the time of the molding. While an electronic component or an electric wire that has high heat resistance may be used, the electronic component or the electric wire that has high heat resistance is expensive, and therefore the production cost of the electronic device may become high.

The electronic component may be joined to the waterproof sheet using an adhesive, a double-stick tape, or the like. The rubber that is used as the waterproof sheet may include silicon so as to secure heat resistance, cold resistance, water resistance, flexibility, and the like. Since the silicon interfere with the adhesiveness of the adhesive or the double-stick tape, when the electronic component is joined to the waterproof sheet using the adhesive, the double-stick tape, or the like, a sufficient joint strength may not be secured.

Figure 1A:
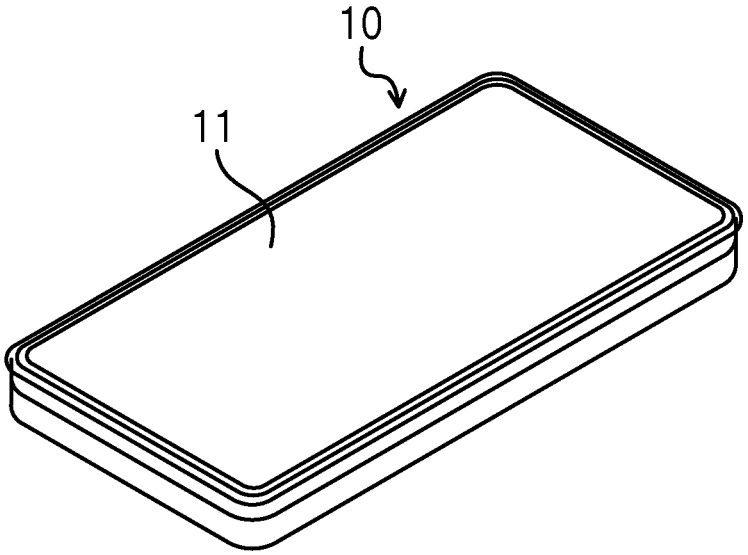
FIG. 1A and FIG. 1B illustrate an exemplary electronic device.
Figure 1B:
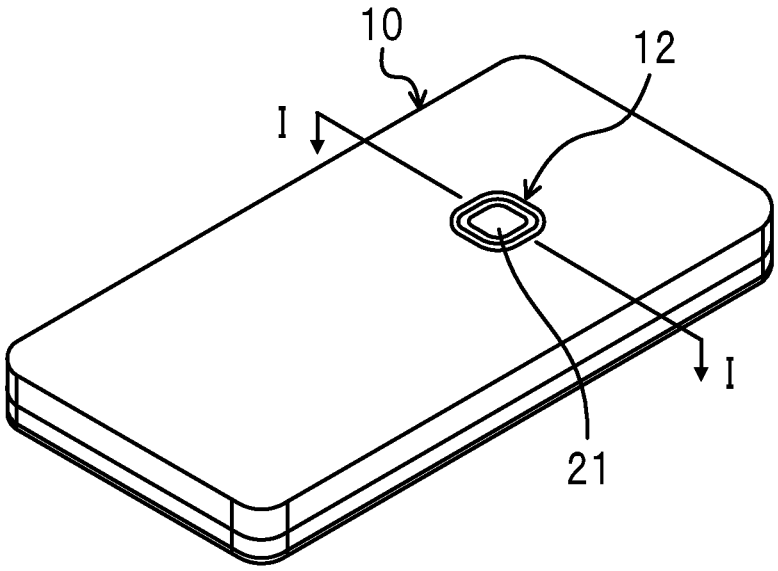
Figure 2:
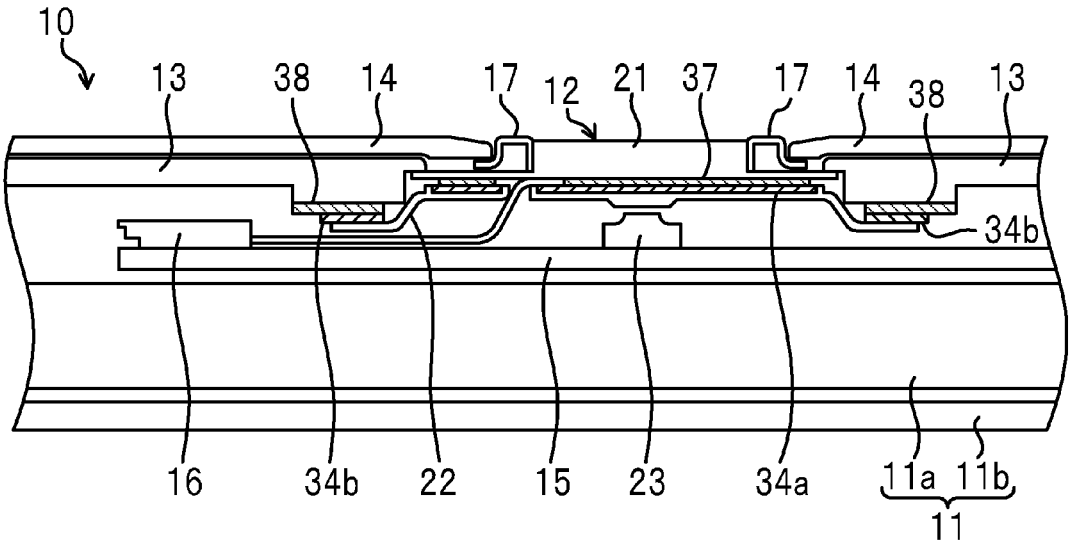
FIG. 2 illustrates an exemplary electronic device.
Figure 3:
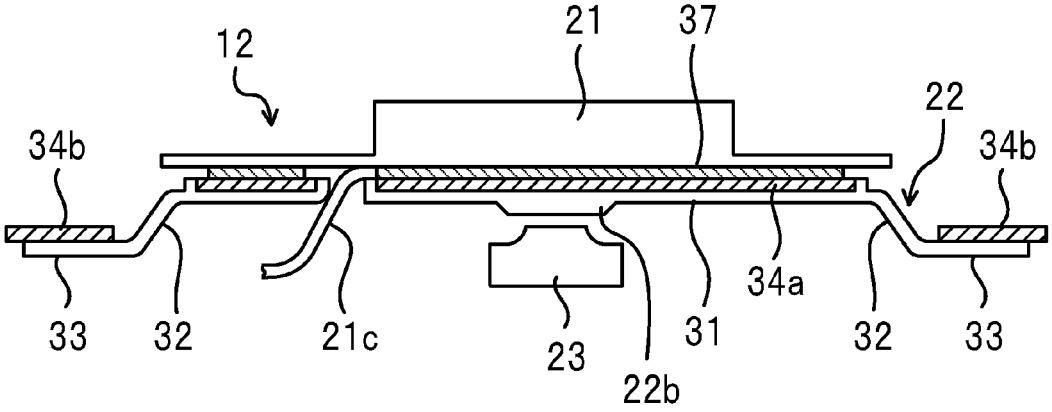
FIG. 3 illustrates an exemplary waterproof type switch.

FIG. 1A and FIG. 1B illustrate an exemplary electronic device. In FIG. 1A, a perspective view indicating one surface side of an electronic device may be illustrated. In FIG. 1B, a perspective view indicating the other surface side of the electronic device may be illustrated. FIG. 2 illustrates an exemplary electronic device. In FIG. 2, a cross-sectional view at the position of a line II-II in FIG. 1B is illustrated. FIG. 3 illustrates an exemplary waterproof type switch. In FIG. 3, the cross-sectional view of a waterproof type switch may be illustrated. The electronic device may be, for example, a mobile terminal.

A display panel 11 equipped with a touch panel is disposed on one surface side of a mobile terminal 10. An icon, a character string, or the like, which are displayed in the display panel 11, is touched by a finger, and processing corresponding to the icon, the character string, or the like is executed.

A waterproof type switch 12 is disposed on the other surface side of the mobile terminal 10. A biometric authentication module 21 is disposed in the key top portion of the waterproof type switch 12. As the biometric authentication module 21, a fingerprint sensor may be used.

As illustrated in FIG. 2, within the housing 13 of the mobile terminal 10, a wiring substrate 15 is disposed where a Central Processing Unit (CPU: not illustrated) and other electronic components (not illustrated) are mounted. A decorative plate 14 is attached on the housing 13, and the top surface of the waterproof type switch 12 may be located on substantially the same surface as the surface of the decorative plate 14. A symbol 11*a* may be a display panel, for example, a liquid crystal panel, and a symbol 11*b* may be a touch panel.

As illustrated in FIG. 3, the waterproof type switch 12 includes the biometric authentication module 21 corresponding to the key top, a waterproof sheet 22 joined to the lower side of the biometric authentication module 21, and a switch 23 that is mounted on the wiring substrate 15 and disposed below the waterproof sheet 22.

Figure 4A:
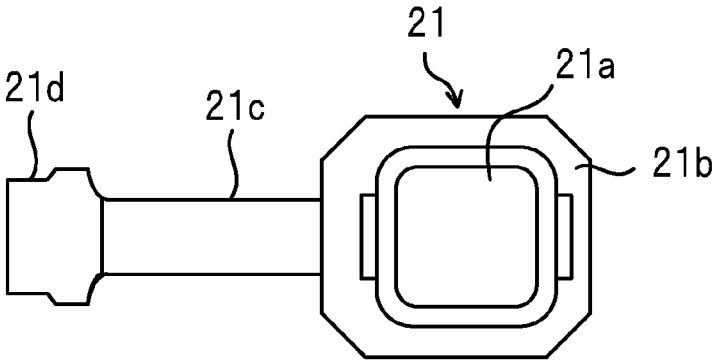
FIG. 4A, FIG. 4B, and FIG. 4C illustrate an exemplary biometric authentication module.
Figure 4B:
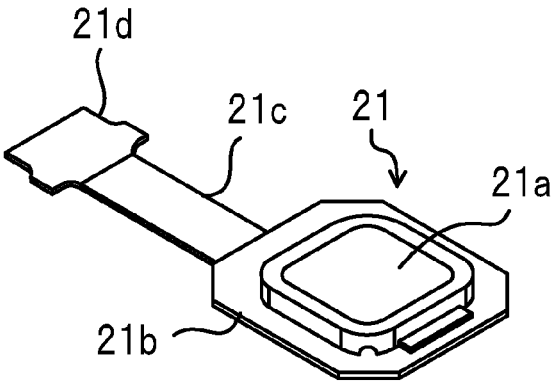
Figure 4C:
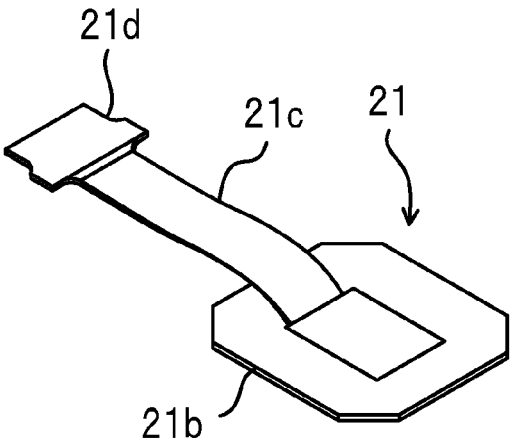

FIG. 4A, FIG. 4B, and FIG. 4C illustrate an exemplary biometric authentication module. FIG. 4A may be the top view of the biometric authentication module 21. FIG. 4B may be a perspective view indicating the front surface side of the biometric authentication module 21. FIG. 4C may be a perspective view indicating the rear surface side of the biometric authentication module 21.

As illustrated in FIG. 4A to FIG. 4C, the biometric authentication module 21 includes a substrate 21*b*, a fingerprint reading portion 21*a* mounted on the substrate 21*b*, a cable 21*c* coupled on the rear surface side of the substrate 21*b*, and a connector 21*d* disposed in the leading end of the cable 21*c*. For example, as illustrated in FIG. 2, when the connector 21*d* is joined to a connector 16 on the wiring substrate 15, an electronic component mounted in the wiring substrate 15 and the biometric authentication module 21 are electrically coupled to each other.

As illustrated in FIG. 2, around the fingerprint reading portion 21*a*, a cover 17 is disposed that seals a clearance gap between the biometric authentication module 21 and the decorative plate 14. The cover 17 may be disposed as desired.

Figure 5A:
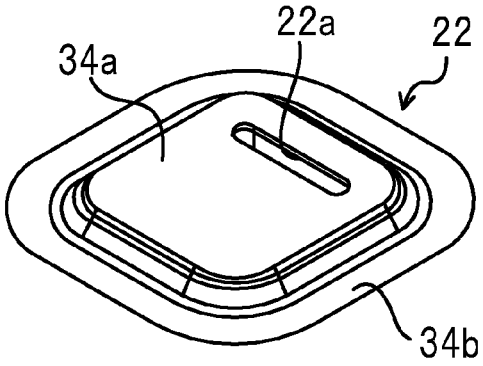
FIG. 5A, FIG. 5B, and FIG. 5C illustrate an exemplary waterproof sheet.
Figure 5B:
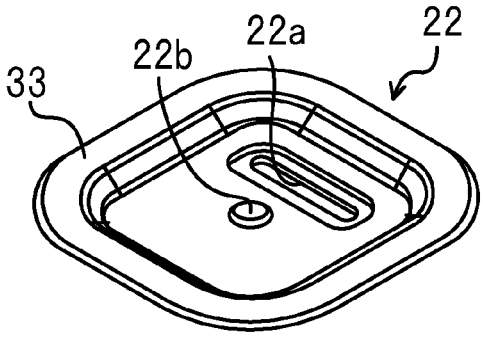
Figure 5C:
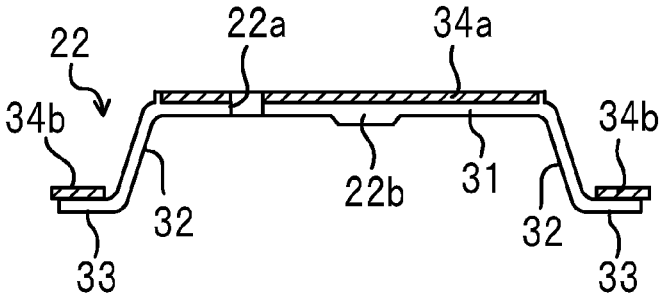

FIG. 5A, FIG. 5B, and FIG. 5C illustrate an exemplary waterproof sheet. FIG. 5A may be a perspective view indicating the front surface side of the waterproof sheet 22. FIG. 5B may be a perspective view indicating the rear surface side of the waterproof sheet 22. FIG. 5C may be a diagram indicating the cross-section shape of the waterproof sheet 22.

The waterproof sheet 22 may include, for example, a rubber that has a thickness of 0.2 mm to 0.3 mm and appropriate elasticity, for example, a resin. As illustrated in FIG. 5A to FIG. 5C, the waterproof sheet 22 may have a shape like an inverted cup, and include a flat portion 31, a side wall portion 32 surrounding the flat portion 31 and communicating with the upper portion of the flat portion 31, and a flange portion 33 extending outward from the lower end of the side wall portion 32 in a direction parallel to the flat portion 31.

A reinforcing plate 34*a* is joined on the flat portion 31, and the biometric authentication module 21 is joined above the reinforcing plate 34*a* through an adhesive 37 (refer to FIG. 3). In the flat portion 31 and the reinforcing plate 34*a*, a hole 22*a* through which the cable 21*c* of the biometric authentication module 21 passes is provided. A reinforcing plate 34*b* is joined on the flange portion 33. As illustrated in FIG. 2, the reinforcing plate 34*b* and the housing 13 are joined to each other through an adhesive 38. Therefore, the opening portion of the housing 13 is sealed by the waterproof sheet 22.

As illustrated in FIG. 3, since the periphery of the hole 22*a* is surrounded by the adhesive 37, water may not enter the housing 13 through the hole 22*a*.

The waterproof sheet 22 may be an integrally molded product where the reinforcing plates 34*a* and 34*b* and the rubber are subjected to an integral molding (insert molding) process. For example, the reinforcing plates 34*a* and 34*b* subjected to primer processing are placed in a mold and a rubber is forced into the mold. Therefore, the waterproof sheet 22 is formed. At this time, an adhesive, for example, a primer, reacts owing to a temperature and a pressure, and the rubber and the reinforcing plates 34*a* and 34*b* are tightly joined to each other.

The primer processing may be performed as desired. The reinforcing plates 34*a* and 34*b* may include a metal resistant to corrosion, such as a stainless steel, and also include a plastic plate or the like, as the reinforcing plates 34*a* and 34*b*.

Figure 6:
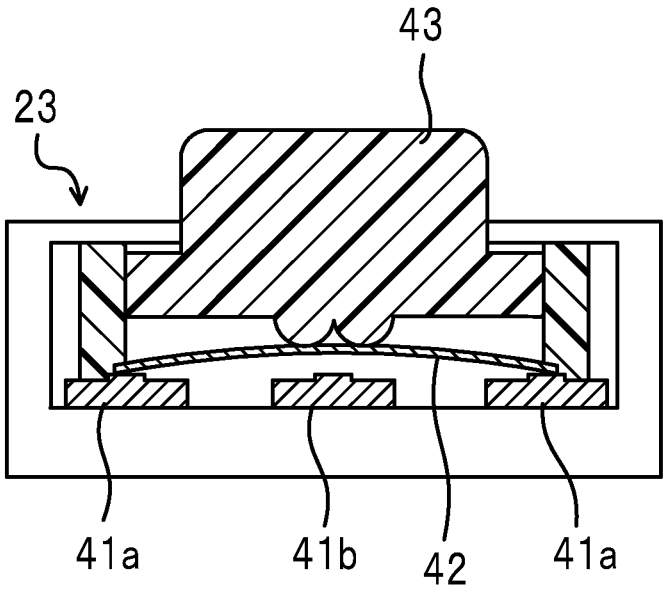
FIG. 6 illustrates an exemplary switch.

FIG. 6 illustrates an exemplary switch. FIG. 6 may be the cross-sectional view of the switch 23. The switch 23 illustrated in FIG. 6 includes fixed contacts 41*a* and 41*b*, a dome-shaped moving contact 42 whose edge portion is in contact with the fixed contact 41*a* to cover over the fixed contact 41*b*, and a button 43 disposed above the moving contact 42.

Figure 7:
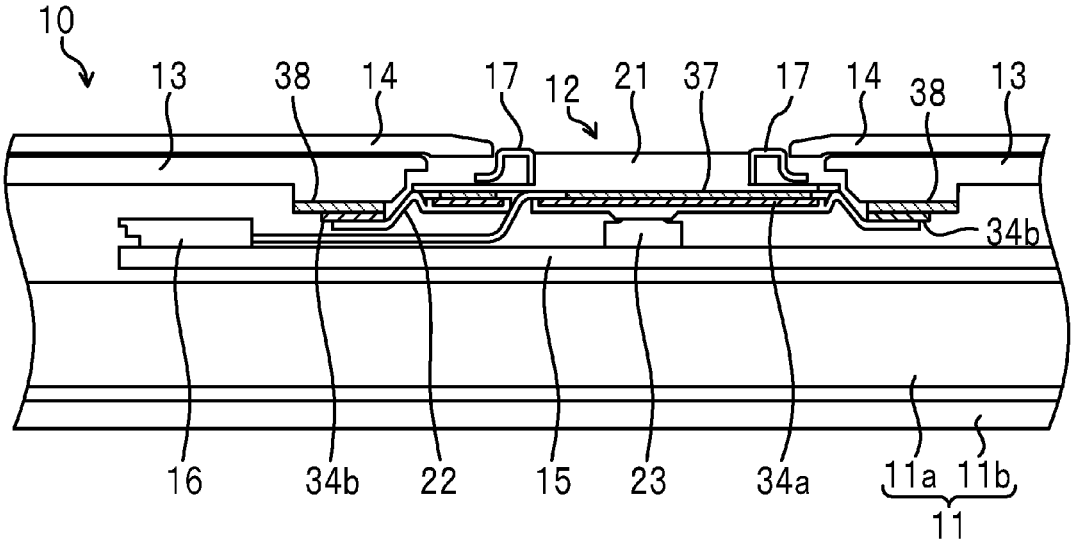
FIG. 7 illustrates an exemplary electronic device.

FIG. 7 illustrates an exemplary electronic device. As illustrated in FIG. 7, when the key top portion, for example, the biometric authentication module 21, is pressed down, the side wall portion 32 of the waterproof sheet 22 is deformed. A convex portion 22*b* provided on the rear surface side of the flat portion 31 makes contact with the button 43 of the switch 23 (refer to FIG. 6), and the button 43 is pressed down. Therefore, the lower portion of the button 43 depresses the moving contact 42. The moving contact 42 is deformed, and the fixed contacts 41*a* and 41*b* are electrically coupled to each other through the moving contact 42.

When, in the mobile terminal 10 including the above-mentioned waterproof type switch 12, for example, the key top portion, for example, the biometric authentication module 21, is pressed down, the waterproof type switch 12 is turned on, and a current is conducted through the biometric authentication module 21. After that, when a finger is placed on the biometric authentication module 21, the biometric authentication module 21 reads a fingerprint. The fingerprint that is read by the biometric authentication module 21 and a fingerprint that is preliminarily registered are subjected to matching operation by the CPU in the mobile terminal 10, and when a match therebetween occurs, the lock of the mobile terminal 10 is released, and the mobile terminal 10 enters an operable state.

In the mobile terminal 10, as illustrated in FIG. 2, a space on the inside of the housing 13 and a space on the outside thereof are separated from each other due to the waterproof sheet 22. Therefore, even if water enters a clearance gap between the decorative plate 14 and the biometric authentication module 21, the water may not enter the wiring substrate 15 side. Failures due to the entry of water may be reduced.

In the waterproof type switch 12, the biometric authentication module 21 and the waterproof sheet 22 may be joined to each other, and the biometric authentication module 21 may be used as the key top. Therefore, it may be easily made thinner, compared with a case where the biometric authentication module is joined on the key top.

Since, in the waterproof type switch 12, the biometric authentication module 21 and the rubber may not be subjected to an integral molding process, the biometric authentication module 21 and the cable 21*c* attached thereto may not have heat resistance. The waterproof type switch 12 may be manufactured at a relatively moderate price.

In the waterproof type switch 12, the waterproof sheet 22 is used where the rubber and the reinforcing plates 34*a* and 34*b* are subjected to the integral molding process. Therefore, a joint strength between the rubber of the waterproof sheet 22 and the reinforcing plates 34*a* and 34*b* may be high, and the reinforcing plates 34*a* and 34*b* may not exfoliate. Since the biometric authentication module 21 is joined on the reinforcing plate 34*a* including a metal using the adhesive 37, a joint strength between the biometric authentication module 21 and the reinforcing plate 34*a* may be high. Therefore, in the waterproof type switch 12, exfoliation of the joint portion may be reduced, and the waterproof type switch may have high reliability.

A fingerprint sensor may be used as the biometric authentication module 21, and a vein sensor may also be used as the biometric authentication module 21. In addition, the biometric authentication module 21 may also be disposed in the key top portion of the waterproof type switch 12, and a Light Emitting Diode (LED), a compact display panel, or another electronic component may also be disposed in the key top portion of the waterproof type switch 12.

The reinforcing plate 34*a* and the biometric authentication module 21 may be joined to each other using the adhesive 37 and the reinforcing plate 34*b* and the housing 13 may be joined to each other using the adhesive 38. In addition, double-stick tapes may also be used in place of the adhesives 37 and 38. The shape of the top view of the waterproof sheet 22 may be substantially quadrangular, and may also be a round shape or another shape.

In a switch of a method where an electrical signal is turned on or off by pressing down the key top, an operational feeling when the key top is pressed down, for example, a click feeling, may be important.

Figure 8:
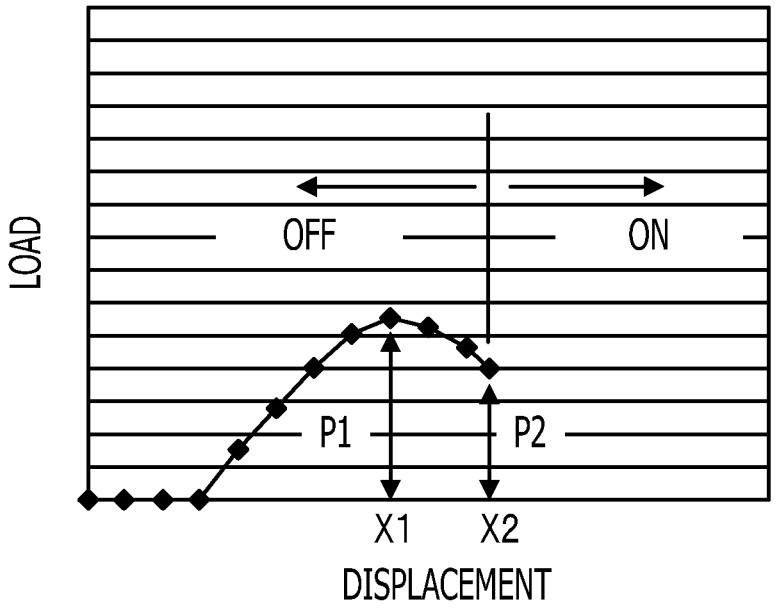
FIG. 8 illustrates an exemplary displacement-load characteristic of a switch.

FIG. 8 illustrates an exemplary displacement-load characteristic of a switch. In FIG. 8, a horizontal axis indicates the displacement of the key top, and a vertical axis indicates a load applied onto the key top. As illustrated in FIG. 8, when the key top is pressed down, the load becomes high with the displacement of the key top. However, when the displacement exceeds X1, the load decreases and the switch is turned on at the time of X2.

The load at the time of the displacement X1, for example, a maximum load may be P1. The load at the time of the displacement X2, for example, a load when the switch is turned on, may be P2. The click feeling is numerical-converted using Expression (1).

$$CL=(P1-P2)/P1 \quad (1)$$

When the CL value expressed by Expression (1) is about 0.3, the best click feeling may be obtained.

Figure 9:
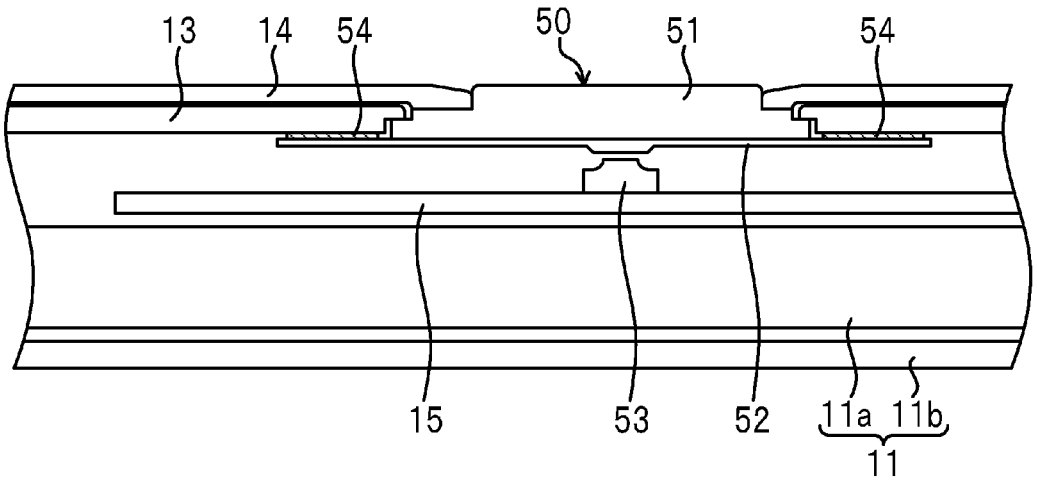
FIG. 9 illustrates an exemplary waterproof type switch.

FIG. 9 illustrates an exemplary waterproof type switch. In FIG. 9, a same symbol is assigned to an element that is substantially the same as or similar to the element illustrated in FIG. 2.

A waterproof type switch 50 illustrated in FIG. 9 includes a key top 51, a waterproof sheet 52, and a switch 53. The waterproof sheet 52 may be flat, and the key top 51 is joined on the waterproof sheet 52. The waterproof sheet 52 is joined to the housing 13 using an adhesive 54. The switch 53 may have the displacement-load characteristic illustrated in FIG. 8.

Figure 10:
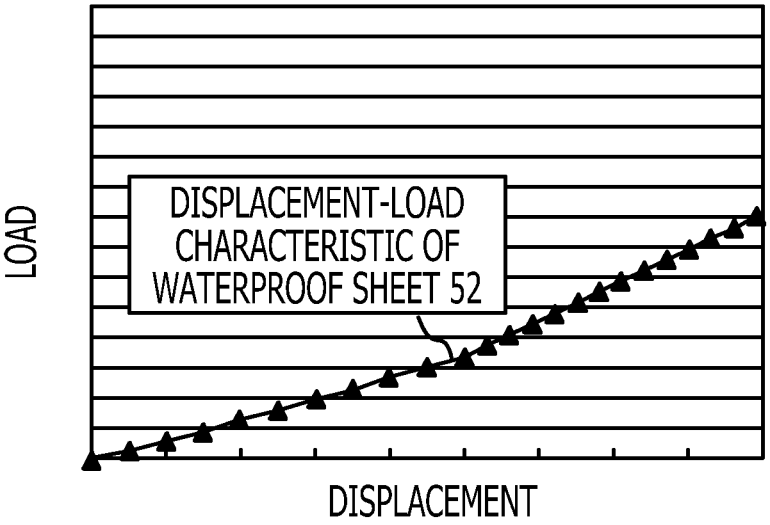
FIG. 10 illustrates an exemplary displacement-load characteristic of a waterproof sheet.
Figure 11:
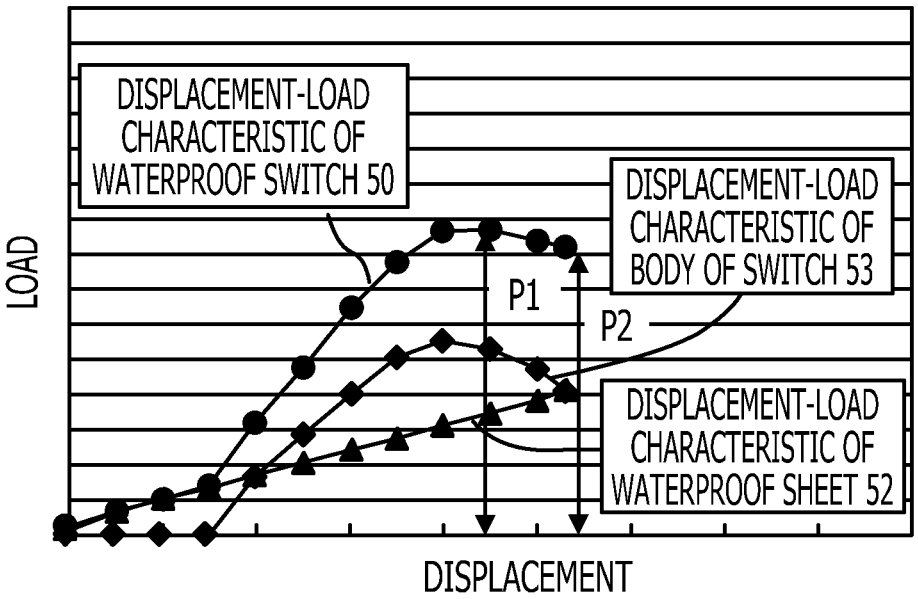
FIG. 11 illustrates an exemplary displacement-load characteristic of a waterproof type switch.

FIG. 10 illustrates an exemplary displacement-load characteristic of a waterproof sheet. The displacement-load characteristic of the flat waterproof sheet 52, illustrated in FIG. 10, may be approximately linear, and a load becomes high with an increase in the displacement. FIG. 11 illustrates an exemplary displacement-load characteristic of a waterproof type switch. The displacement-load characteristic of the waterproof type switch 50, illustrated in FIG. 11, may correspond to the combination of the displacement-load characteristic of the switch 53 and the displacement-load characteristic of the waterproof sheet 52. The CL value calculated in accordance with Expression (1) may fall below 0.3. The click feeling of the waterproof type switch 50 illustrated in FIG. 9 may be not so good.

In a case where the waterproof sheet 22 has a cup shape and the reinforcing plate 34*a* is joined to the flat portion 31 of the waterproof sheet 22, when a load is applied onto the key top portion, for example, the biometric authentication module 21, the side wall portion 32 may be deformed. Only the side wall portion 32 may be deformed.

Figure 12:
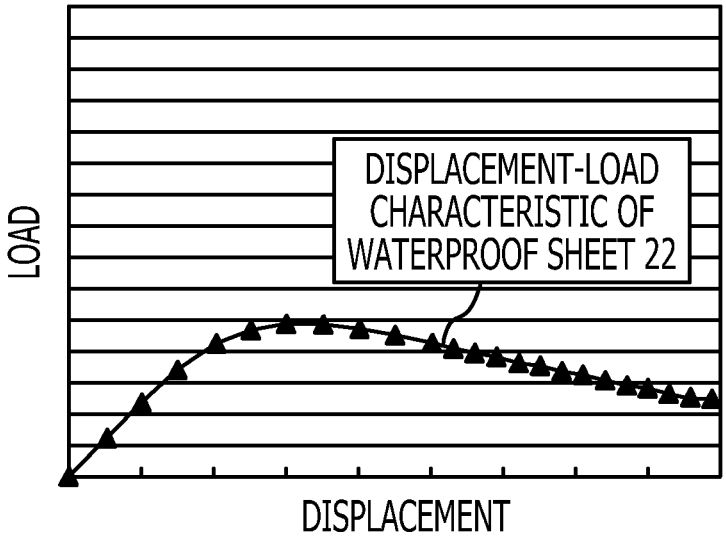
FIG. 12 illustrates an exemplary displacement-load characteristic of a waterproof sheet.

FIG. 12 illustrates an exemplary displacement-load characteristic of a waterproof sheet. In FIG. 12, while a load increases with a displacement until a time point, when having passed across a time point, the side wall portion 32 buckles and the load decreases. The displacement-load characteristic of the waterproof sheet 22 may be similar to the displacement-load characteristic of the switch 23. By adjusting the positions of the peaks of the displacement-load characteristics of the two, a good click feeling may be obtained.

Figure 13:
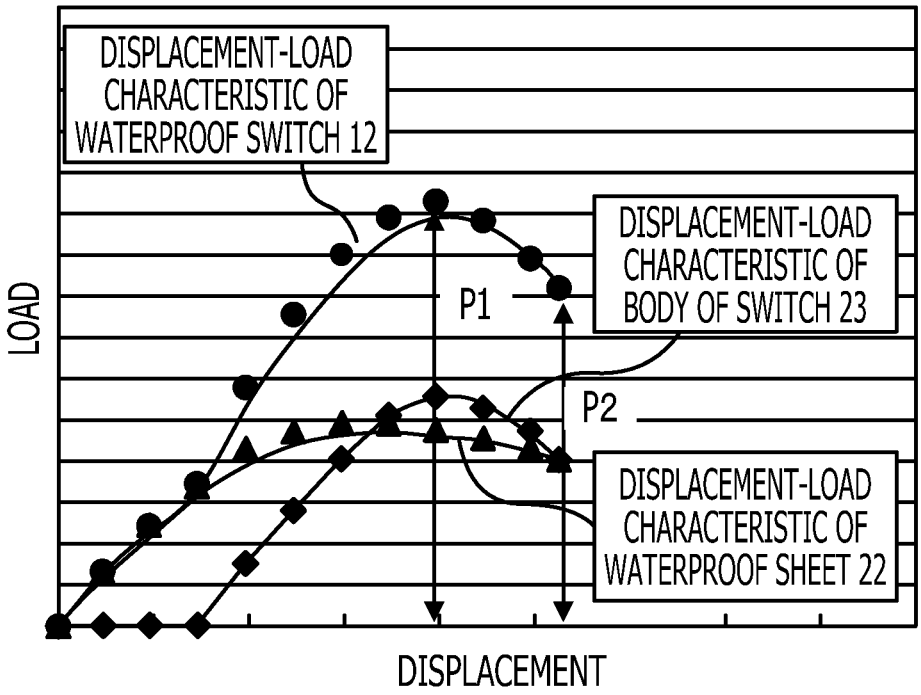
FIG. 13 illustrates an exemplary combination of a displacement-load characteristic of a waterproof sheet and a displacement-load characteristic of a switch portion.

FIG. 13 illustrates an exemplary combination of the displacement-load characteristic of a waterproof sheet and the displacement-load characteristic of a switch. As illustrated in FIG. 13, the peak position of the displacement-load characteristic of the waterproof sheet 22 and the peak position of the displacement-load characteristic of the switch 23 are adjusted, and the CL value calculated in accordance with Expression (1) may be set to about 0.3. Therefore, the click feeling of the waterproof type switch 12 may become good. For example, the waterproof sheet 22 and the switch 23 may be disposed so that the peak position of the displacement-load characteristic of the waterproof sheet 22 and the peak position of the displacement-load characteristic of the switch 23 coincide with each other.

Figure 14:
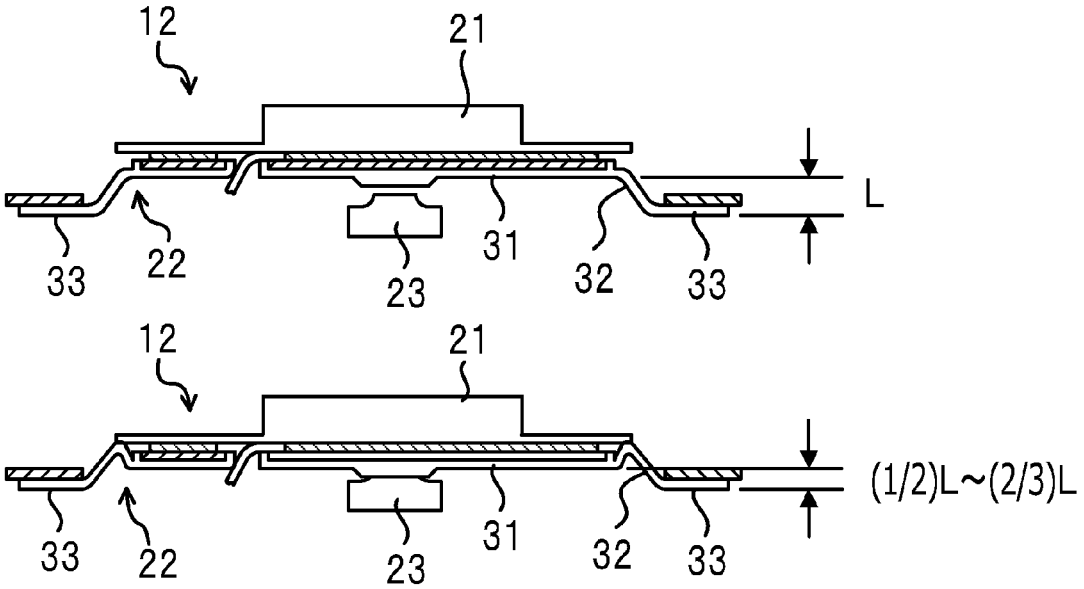
FIG. 14 illustrates an exemplary waterproof type switch.

FIG. 14 illustrates an exemplary waterproof type switch. When the waterproof sheet 22 has a cup shape as illustrated in FIG. 5 and a distance from the bottom surface of the flange portion 33 of the waterproof sheet 22 to the bottom surface of the flat portion 31 is L as illustrated in FIG. 14, a maximum load may substantially occur between (½) L and (⅔) L. When the waterproof sheet 22 and the switch 23 are disposed so that a position where the maximum load of the switch 23 occurs is set to a position located (½) L to (⅔) L above the bottom surface of the flange portion 33 of the waterproof sheet 22, the CL value of the waterproof type switch 12 may become about 0.3.

Figure 15:
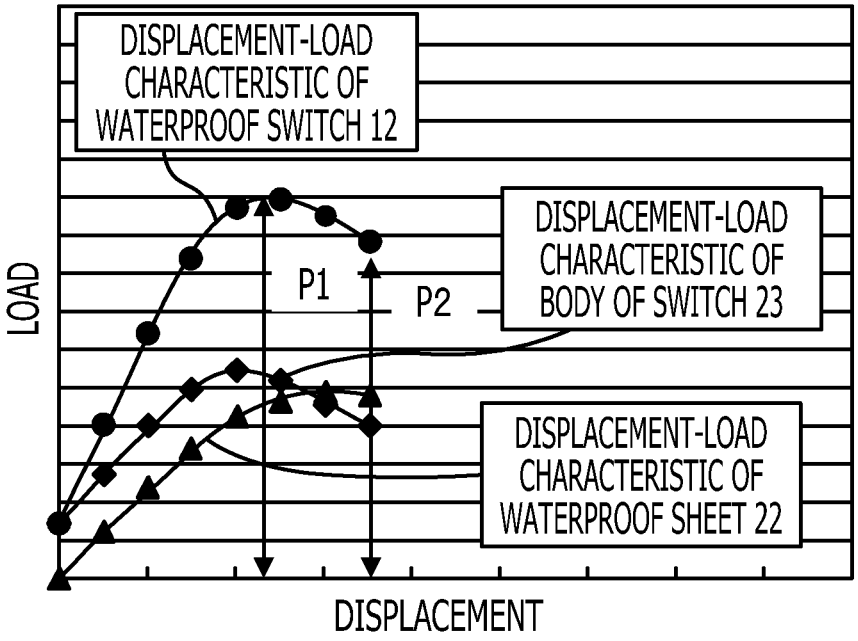
FIG. 15 illustrates an exemplary displacement-load characteristic of a switch.

FIG. 15 illustrates an exemplary displacement-load characteristic of a switch. FIG. 15 may illustrate a displacement-load characteristic when the position where the maximum load of the switch 23 occurs is located at a position higher than (⅔) L. As illustrated in FIG. 15, when the position where the maximum load of the switch 23 occurs is located at a position higher than (⅔) L, the CL value calculated in accordance with Expression (1) may fall below 0.3 and the click feeling may be reduced.

Figure 16:
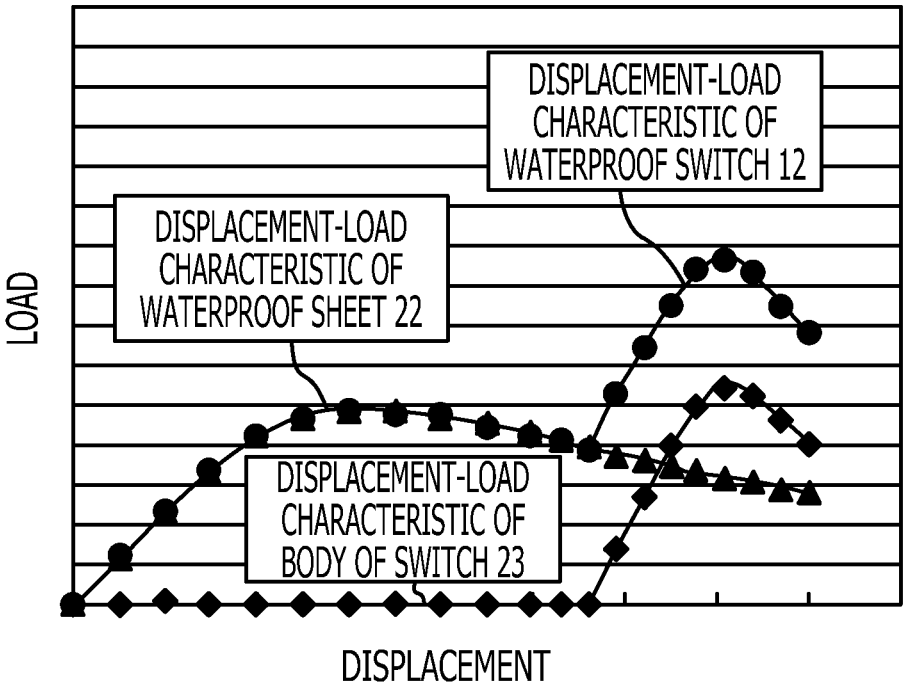
FIG. 16 illustrates an exemplary displacement-load characteristic of a switch.

FIG. 16 illustrates an exemplary displacement-load characteristic of a switch. FIG. 16 may illustrate a displacement-load characteristic when the position where the maximum load of the switch 23 occurs is located at a position lower than (½) L. As illustrated in FIG. 16, when the position where the maximum load of the switch 23 occurs is located at a position lower than (½) L, the two peaks of the displacement-load characteristic of the waterproof type switch may occur. Even if the switch has not been turned off, a misconception that the switch has been turned on may occur.

Figure 17:
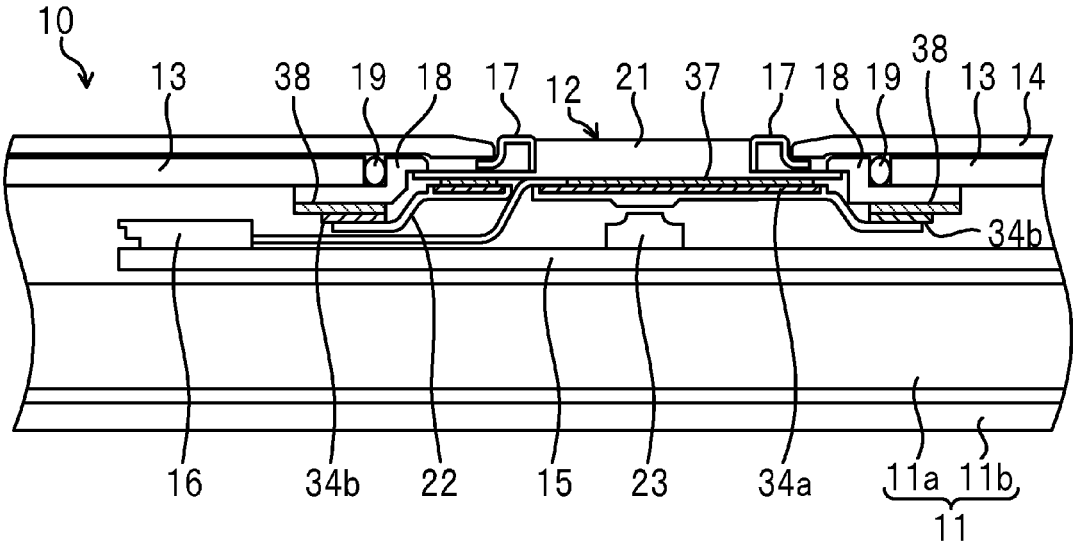
FIG. 17 illustrates an exemplary electronic device.

FIG. 17 illustrates an exemplary electronic device. In an electronic device illustrated in FIG. 17, using a method different from the electronic device illustrated in FIG. 1, a waterproof type switch may be attached. Other elements illustrated in FIG. 17 may be substantially the same as or similar to the elements illustrated in FIG. 1. In FIG. 17, a same symbol is assigned to an element that is substantially the same as or similar to the element illustrated in FIG. 1, and the description thereof may be omitted or reduced.

The waterproof sheet 22 of the waterproof type switch 12 may be directly joined to the housing 13 using the adhesive 38. In this case, when the biometric authentication module 21 has failed to operate properly, the biometric authentication module 21 may be replaced along with the the housing 13.

The waterproof sheet 22 is joined to a pedestal 18. An O-ring 19 is disposed, as a water stop component, between the pedestal 18 and the housing 13, and the waterproof sheet 22 is disposed so as to be attachable to and detachable from the housing 13. Therefore, for example, even if the biometric authentication module 21 has failed to operate properly, the waterproof sheet 22 and the biometric authentication module 21 may be replaced and the housing 13 may not be replaced.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A waterproof type switch comprising:

a waterproof sheet including a flat portion and a side wall portion disposed around the flat portion, an upper portion of the side wall portion coupled to an edge portion of the flat portion;

a switch disposed below the flat portion; and an electronic component coupled to an upper surface of the flat portion, the electric component being used as a key top, wherein the waterproof sheet includes a rubber and a reinforcing plate including a first reinforcing plate disposed on the upper surface of the flat portion and coupled to the electric component, wherein a hole is formed so as to pass through the flat portion and the reinforcing plate.

2. The waterproof type switch according to claim 1, wherein the water proof sheet is formed by integrating the rubber and the reinforcing plate.

3. The waterproof type switch according to claim 1, wherein the waterproof sheet includes a flange portion extending outward from a lower end of the side wall portion, and a second reinforcing plate is disposed on an upper surface the flange portion.

4. The waterproof type switch according to claim 1, wherein upon pressing the electronic component, the side wall portion of the waterproof sheet is deformed and a lower surface of the flat portion makes contact with the switch.

5. The waterproof type switch according to claim 1, wherein the electronic component includes a biometric authentication module.

6. The waterproof type switch according to claim 1, wherein the hole on the flat portion communicates with the electronic component.

7. The waterproof type switch according to claim 1, wherein the flat portion includes a convex portion formed under a lower surface of the flat portion.

8. An electronic device comprising:

a housing; and a waterproof type switch disposed in an opening portion of the housing, the waterproof type switch separating an inside and an outside of the housing, wherein the waterproof type switch includes a waterproof sheet including a flat portion and a side wall portion disposed around the flat portion, an upper portion of the side wall portion coupled to an edge portion of the flat portion;

a switch disposed below the flat portion; and an electronic component coupled to an upper surface of the flat portion, the electric component being used as a key top, wherein the waterproof sheet includes a rubber and a reinforcing plate including a first reinforcing plate disposed on the upper surface of the flat portion and coupled to the electric component, wherein a hole is formed so as to pass through the flat portion and the reinforcing plate.

9. The electric device according to claim 8, wherein the water proof sheet is formed by integrating the rubber and the reinforcing plate.

10. The electronic device according to claim 8, wherein the waterproof sheet includes a flange portion extending outward from a lower end of the side wall portion, and a second reinforcing plate is disposed on an upper surface the flange portion.

11. The electronic device according to claim 8, wherein the waterproof sheet is attached through a water stop member so as to be attachable to and detachable from the housing.

12. The electronic device according to claim 8, wherein the electronic component includes a biometric authentication module.

13. The electronic device according to claim 8, wherein a peak position of a displacement-load characteristic of the waterproof sheet and a peak position of a displacement-load characteristic of the switch coincide with each other.

14. The electronic device according to claim 8, wherein when a height of the side wall portion is L, the switch is disposed so that a peak of a displacement-load characteristic is located at a position of from (½)L to (⅔)L.

* * * * *